US007080605B1

(12) United States Patent
Anderson

(10) Patent No.: US 7,080,605 B1
(45) Date of Patent: Jul. 25, 2006

(54) PIVOTING FEED ROLLER

(76) Inventor: Martin L. Anderson, 6852 Estes Ave. NW., Maple Lake, MN (US) 55358

( * ) Notice: Subject to any disclaimer, the term of this patent is extended or adjusted under 35 U.S.C. 154(b) by 0 days.

(21) Appl. No.: 11/031,278

(22) Filed: Jan. 7, 2005

(51) Int. Cl.
*D05B 27/10* (2006.01)

(52) U.S. Cl. ..... 112/318

(58) Field of Classification Search ..... 112/7, 112/314, 318, 320, 322
See application file for complete search history.

(56) References Cited

U.S. PATENT DOCUMENTS 4,290,376 A * 9/1981 Brusasca et al. ..... 112/470.32
5,010,834 A * 4/1991 Iimuro et al. ..... 112/302
5,209,171 A 5/1993 Anderson ..... 112/7
5,331,910 A * 7/1994 Mukai et al. ..... 112/470.32
5,875,723 A 3/1999 Lobur ..... 112/7
6,055,918 A 5/2000 Hajjar et al. ..... 112/7
6,082,277 A * 7/2000 Block et al. ..... 112/2.1

* cited by examiner

*Primary Examiner*—Danny Worrell
(74) *Attorney, Agent, or Firm*—Nikolai & Mersereau, P.A.

(57) ABSTRACT

A pivoting twin roller for feeding a material to a sewing machine is disclosed. The twin rollers grip the material with serrated rollers, which rotate at the same rate for uniformly moving the material relative the sewing machine. The twin rollers press down on the material with equal force due to the central pivot point, which improves the feed of the material. The pivoting twin rollers also allow for automatic feeding of material to the sewing machine. A spring loading on the housing for the pivoting twin rollers applies downward pressure on the material being sewn for a sure grip thereon. The downward pressure also insures that the rollers will press down with equal force on uneven height materials since the pivot adjusts the height of the rollers to the height of the materials and thus prevents floating which can lead to jamming of the sewing machine.

9 Claims, 3 Drawing Sheets

PIVOTING FEED ROLLER

BACKGROUND OF THE INVENTION

1. Field of the Invention

This invention relates to sewing machines and more particularly to a carpet sewing machine with twin feed rollers having a pivot point between the rollers to better feed the material to be sewn to the sewing machine.

2. Description of the Related Art

Twin roller feeds for material have been used in sewing machines. The twin rollers are synchronized to rotate together and both engage the material to be sewn, such as carpeting, at the same time. The rollers are fixed at the same height and both rollers travel up and down at the same rate. Problems arise when the material to be sewn is of uneven thickness since one roller will be pressing down on the material too hard and apply too much force on the material while the other roller is floating above the material providing little or no traction, thus causing bunching of the material between the rollers. This may cause an uneven feed resulting in jamming or uneven stitching.

Some twin roller feeders have two sets of gears and clutches which have to be synchronized to drive the rollers at the same speed in order to try to provide the same force on the material by the front an rear rollers. The separately driven rollers require separate gears and clutches which take up space and therefore space the rollers further apart. As the rollers are moved further apart the material being sewn is not as easy to turn in the sewing machine making it more difficult to sew along curves or around corners. Thus the operator may have to stop sewing and lift the twin rollers off the material to turn the material and lower the twin rollers back down on the material before commencing sewing. Further, separately driven rollers when not properly synchronized with cause bunching and jamming of the material due to uneven roller speeds.

The standard double roller sewing machines require the pressure of the spring pressing down on the double rollers and the height of the double rollers to be constantly adjusted for thicker material or a thinner materials or materials with different durometers to increase or decrease the optimum downward pressure of the double roller on the material being fed into the sewing machine. The operator will have to make these adjustments for every different material being sewn. Thus with the current double roller designs the rollers have to be lifted up and then placed on top of the material to be sewn when the material is fed into the sewing machine. The rollers have to be set at the proper height for each new thickness or durometer of material fed into the sewing machine. Further, the registration spring has to be calibrated for each different high or durometer of material fed into the sewing machine to provide the correct pressure of the rollers on the material.

Another problem with prior art double roller designs is that the extra clutches and gears increase the complexity and cost of the sewing machine and make the machine less robust because the added clutches and gears add more parts, which can fail reducing the reliability of the sewing machine.

SUMMARY OF THE INVENTION

A pivoting double roller with the pivot point centered one half way between the rollers places even pressure on even or uneven height materials being fed into the sewing machine as the high portion of the material forces one roller up and the other roller down so as to maintain an even pressure on the material. With the rollers rotating at the same rate the material is forced through the machine with even force from the front and back rollers for a more even feeding, which enhances sewing performance, by reducing jamming and promoting more even stitching.

A pivoting double roller automatically feeds the material into the sewing machine because the lead roller will automatically lift to the proper height to receive the material to be sewn while forcing the back roller downward. When the material reaches the back roller the back roller will be lifted to the proper height to place even pressure on the front and back rollers. Similarly, at the end of the material fed to the sewing machine the front roller will drop and the rear roller will rise. If the material is of uneven durometery or if the material is of uneven thickness the rollers will pivot up and down to provide even pressure and even force on the material. The material is then fed through the sewing machine at an even rate preventing bunching and jamming problems while allowing even stitching. Preventing bunching of the material is important because bunching can lead to missed or skipped stitches in the sewing machine, which can damage needles, hooks or loopers.

Both of the rollers in the pivoting double roller are rotated at the same rate by a common gear for an even speed of the material under the roller, and with even downward pressure on both rollers which prevents bunching and eliminates synchronization problems.

The pivoting double roller has a common gear drive which reduced the space required for the rollers compared with two separately geared clutched and synchronized rollers allowing for easier turning of the material being sewn.

The pivoting double roller eliminates the need for the operator to adjust the height and spring tension on the rollers such that any material can be run through the sewing machine without having down time to set up the sewing machine for different materials.

OBJECTS OF THE INVENTION

It is an object of the invention to provide an automatic feed for the sewing machine.

It is an object of the invention to provide even pressure on the front and back rollers.

It is an object of the invention to provide a pivoting housing for the pair of rollers so that the rollers can be at different heights.

It is an object of the invention to provide even pressure on material of uneven height.

It is an object of the invention to prevent jams.

It is an object of the invention to promote even stitching.

It is an object of the invention to prevent damage to needles, hooks and loopers.

It is an object of the invention to promote even more aggressing feeding of material to the sewing machine.

It is an object of the invention to prevent floating of one roller over the top of uneven material.

It is an object of the invention to reduce maintenance costs.

It is an object of the invention to reduce the cost of purchasing a sewing machine.

It is an object of the invention to increase reliability of the sewing machine.

It is an object of the invention to have the rollers closer together to promote sewing around curves and corners.

It is an object of the invention to eliminate down time between sewing jobs on different materials caused by adjusting the height of the rollers and the spring tension on the rollers to provide downward pressure on the rollers.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
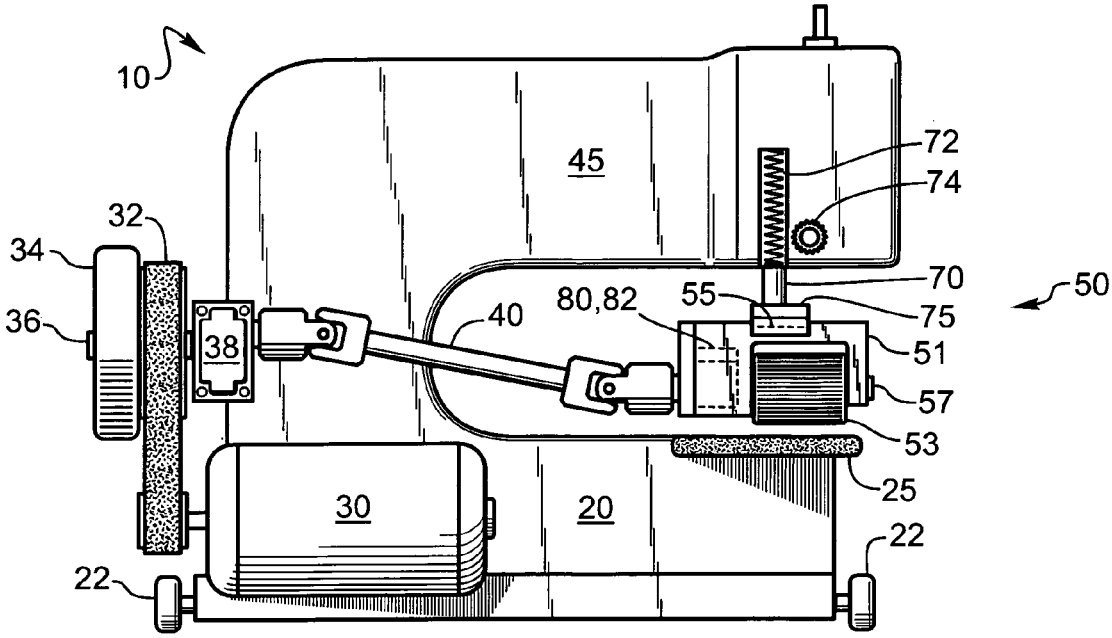
FIG. 1 is a side view of a sewing machine with the pivoting twin roller feed.

In laying carpet a sewing machine 10 is sometimes used to add a binding tape to the edge of the carpet 15. The sewing machine 10 can be on wheels 22 and run along the edge of the carpet 15 or the carpet 15 can be run through a stationary sewing machine 10. In either case the carpet 15 has to be fed through the sewing machine 10 with a firm grip on the carpet 15 to advance the carpet 15 with each stitch.

In general a sewing machine 10 having a frame 20 may optionally have wheels 22 for moving the sewing machine 10 along the edge of a carpet 15. The sewing machine 10 has an electric motor 30 for driving a belt 32, which rotates shaft 36 having a flywheel 34 thereon. Shaft 36 also drives a cam and a one-way clutch bearing mechanism shown generally as box 38, which then drives drive shaft 40 connected to pivoting twin feed roller 50. The a one-way clutch bearing mechanism box 38 also contains a means for allowing a shaft to slide therein to compensate for the up and down motion of the twin roller housing 51.

The pivoting twin feed roller 50 has a first roller 52 supported on shaft 56 and a second roller 53 supported on a shaft 57. The shafts 56 and 57 are supported in pivoting twin feed roller housing 51 by apertures 156 and 157 respectively. The pivoting twin feed roller housing 51 has a pivot point centered one half way between the roller shafts 56 and 57 at pivot shaft aperture 155, which has pivot shaft 55 therein. The pivot shaft aperture 155 is shown located above the shaft apertures 156 and 157 but can be centered between shaft apertures 156 and 157 or below them. Pivot shaft 55 pivotally supports pivot block 75 which is attached to rod 70, which is connected to arm 45 of sewing machine 10. Rod 70 has an adjustable pressure by use of spring 72 and adjustable spring compression setting 74 in arm 45. The rod can also be set at different positions relative to housing 51 by use of setscrew 78. The rod 70 therefore can be adjusted to have different pressures at different heights above table 25 on the sewing machine frame 20. For the best results the pivot shaft should be exactly centered between the roller shafts 56 and 57 to provide equal pressure on both rollers 52 and 53.

Figure 5:
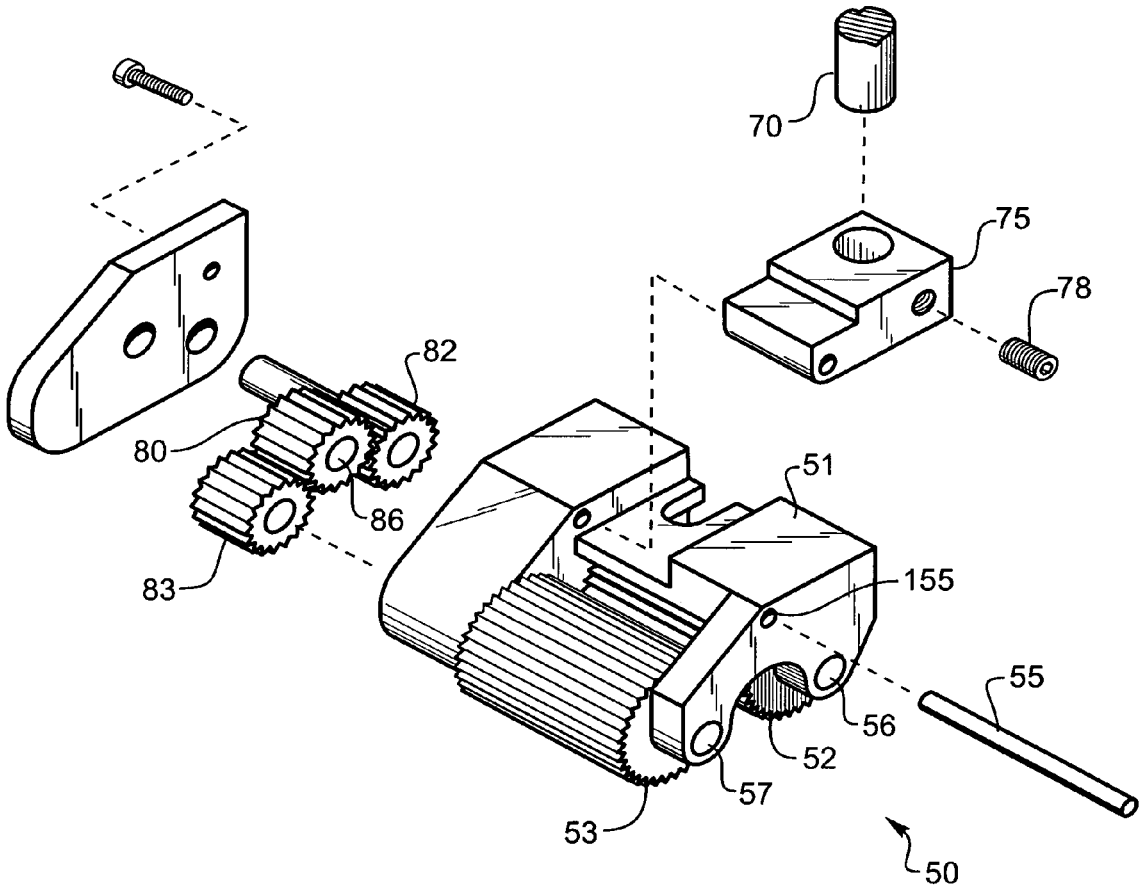
FIG. 5 is an expanded oblique view of the pivoting twin roller feed housing with gears to turn the rollers at the same rate.

As shown in FIG. 5 the serrated rollers 52 and 53 have gears 82 and 83 respectively on shafts 56 and 57. A central gear 80 ensures that the twin serrated rollers 52 and 53 turn at the same rate such that the carpet or other material 15 will travel under the twin serrated rollers 52 and 53 at the same speed. The power from shaft 40 can be connected to the center shaft 86 such that center gear 80 engages gears 82 and 83 to turn them at the same rate. Alternatively shaft 40 can be connected to shaft 56 or 57.

Although FIG. 5 shows the serrated rollers 52 and 53 driven by gears 82 and 83 on shafts 56 and 57, any means for coordinating the rotation of the serrated rollers 52, 53 is acceptable. Such means may be by belts, timing belts, chains or other means.

Figure 3:
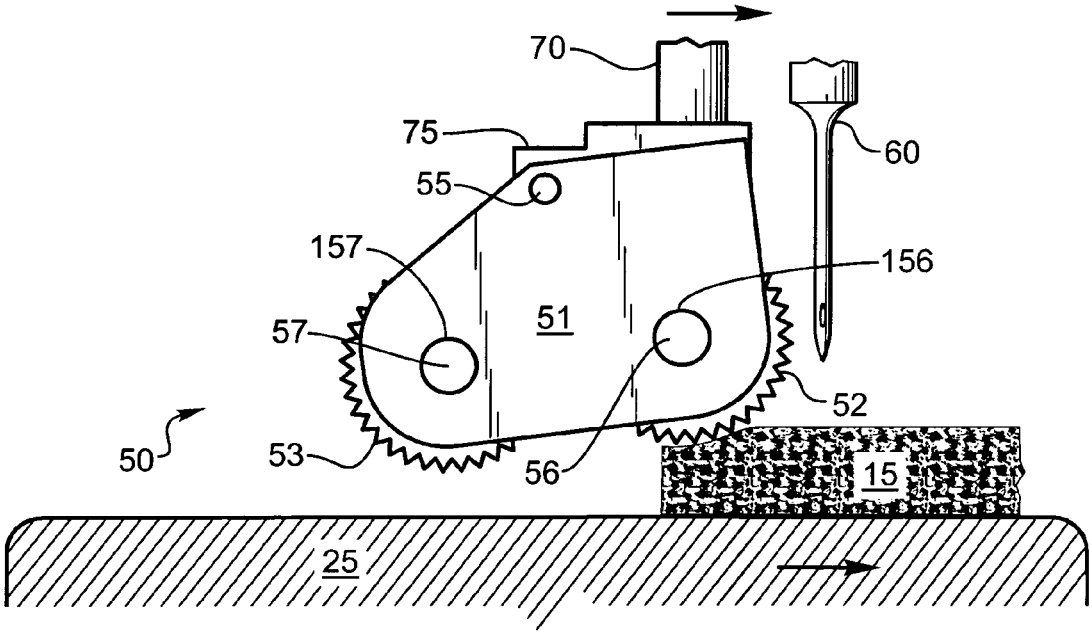
FIG. 3 is a side view of the pivoting twin roller feed with a piece of material beginning to be fed to the sewing machine.

As shown in FIG. 3 when a carpet or other material 15 is fed into the sewing machine 10 on table 25 the leading edge of the carpet 15 will engage the lead serrated roller 52 and lift the front of the pivoting feed roller housing 51 as it pivots on pivot shaft 55 in aperture 155. Spring 72 applies pressure to the top of the carpet 15 and firmly holds carpet 15 in place. The pressure of the serrated roller 52 is automatically adjusted by spring 72 to capture carpet 15 and feed it under the leading serrated roller 52 to serrated roller 53 which then pivots and as carpet 15 is moved thereunder to adjust the pressure applied by serrated roller 53 on carpet 15. As carpet 15 passes under serrated roller 53 housing 51 pivots on pivot shaft 55 and spring 72 further adjusts the pressure of the serrated rollers 52 and 53 on the carpet 15 to keep the pressure equal even if the height of the carpet changes. The carpet 15 is thus automatically fed into the sewing machine 10 without any adjustments made by the operator and applies equal pressure to serrated rollers 52 and 53 on carpet 15 to transport the carpet relative to the machine without bunching or jamming. Typically a needle 60 having a needle driving mechanism connected to cam and a one way clutch bearing mechanism 38 moves the needle 60 up and down as the carpet 15 moves thereunder. The needle mechanism is well understood and is not shown in the figures.

Figure 2:
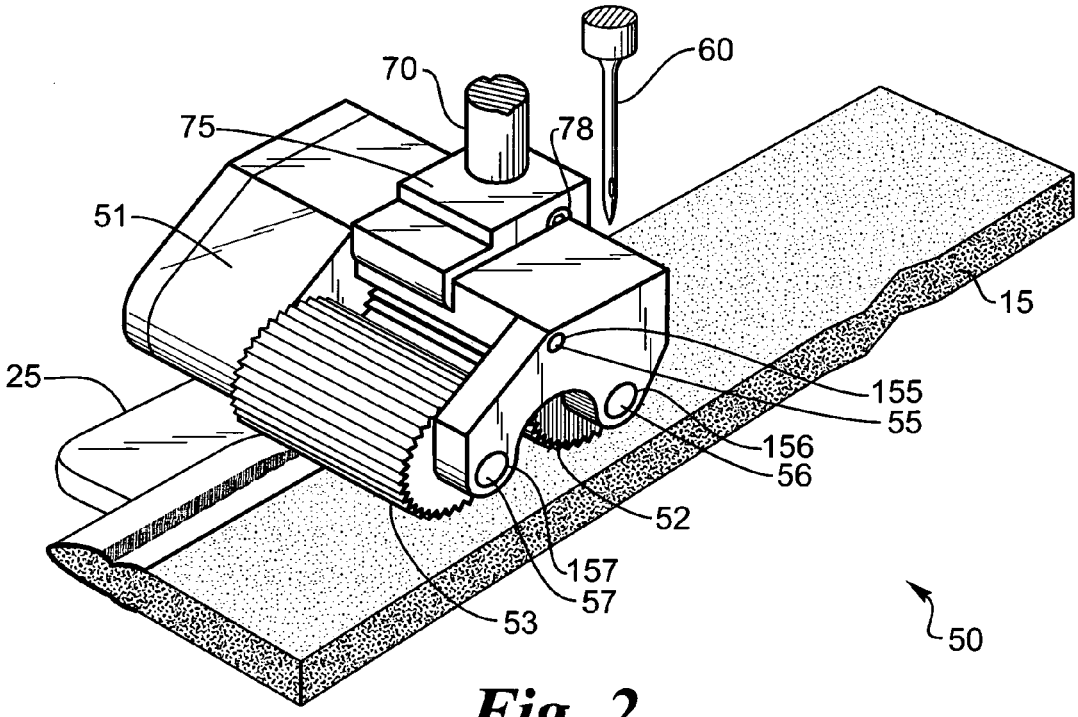
FIG. 2 is a rear perspective view of the pivoting twin roller feed with a uniform height material being sewn.

As FIG. 2 shows, when the carpet or other material 15 is of uniform height the serrated rollers 52 and 53 engage the carpet 15 at an even height and with even force and speed, to propel the carpet 15 thought the sewing machine 10 or the sewing machine 10 along the carpet 15 when the sewing machine 10 is on wheels 22.

Figure 4:
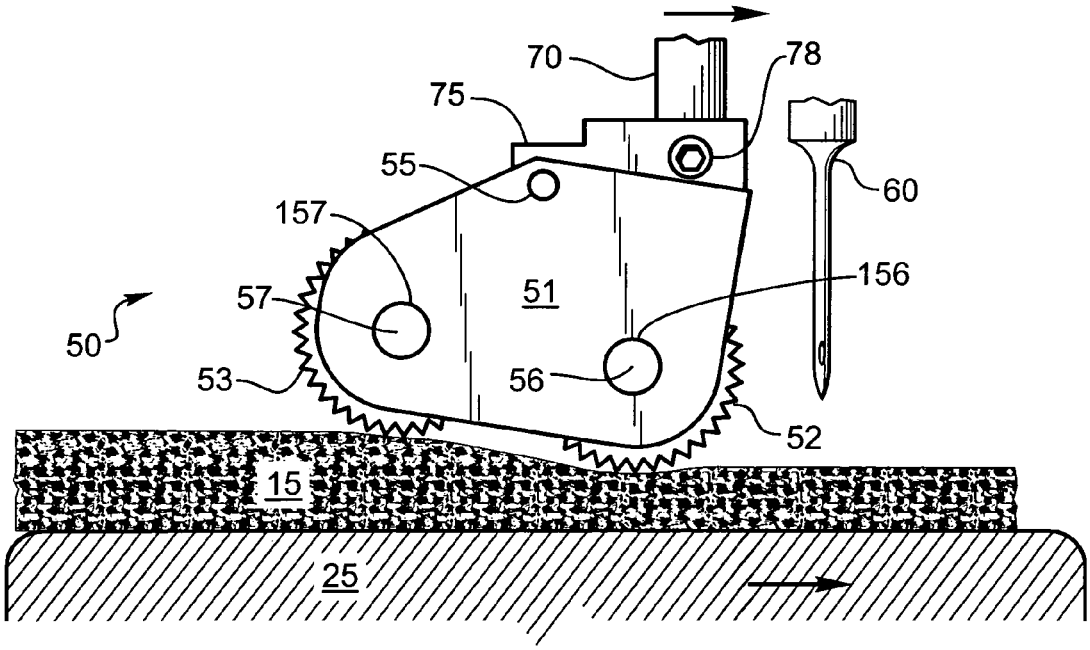
FIG. 4 is a side view of the pivoting twin roller feed with a piece of uneven height material being to be fed to the sewing machine.

As shown in FIG. 4 when the carpet or other material 15 is of uneven height the twin roller housing 51 pivots on pivot shaft 55 such that the lower point on the material 15 is engaged by one serrated wheel, here serrated roller 52 while serrated roller 53 engages the higher portion of the material 15. The pivoting occurs because the spring 72 presses the pivoting twin roller housing 51 downward. By having both serrated rollers 52 and 53 engage the carpet or material 15 and rotate at the same rate the carpet will not jam and the pivoting twin roller housing 51 prevents one serrated roller from floating over the top of the material 15.

The spring loaded twin pivoting roller housing 51 provides even pressure on both serrated rollers 52 and 53 to improve the feeding of material 15 to the sewing machine 10 and to automatically adjust the initial feed so that an operator does not have to set the height of the rollers for each new job. The pivoting housing 51 for the serrated rollers 52, 53 allows the rollers 52, 53 to adjust to variable height materials 15 moving through the sewing machine 10 and prevents jamming.

The serrated rollers 52 and 53 can be replaced by other types of rollers such a ribbed rollers, rubber rollers of different durometers, or plastic rollers.

Although the sewing machine has been described as working on carpeting, it could be working on any material for uses such as for boat sails, tents, balloons, bamboo matting, matting in general, or any other uses.

Obviously, many modifications and variations of the present invention are possible in light of the above teachings. It is therefore to be understood that, within the scope of the appended claims, the invention may be practiced otherwise than as specifically described.

What is claimed is:

1. A pivoting feed roller comprising:

a first side wall and a second side wall held in parallel by connecting material therebetween, the first side wall and the second side wall having an first aperture for engaging a first shaft with a first roller, the first side wall and the second side wall having a second aperture for engaging a second shaft with a second roller, the first side wall and the second side wall having a third aperture for engaging a pivot shaft located between the first shaft and the second shaft, a pivot block having an aperture therethrough for pivotally engaging the pivot shaft, such that the first side wall and the second side wall pivot on the pivot shaft relative to the pivot block, a spring loaded rod connected to the pivot block for providing a downward pressure on the first and second rollers, a gear on the first shaft, a gear on the second shaft and a gear on the pivot shaft connected to the gear on the first shaft and to the gear on the second shaft for rotating the first and second rollers in unison at the same rate.

2. A pivoting feed roller as in claim 1 wherein, a drive shaft connects to the gear on the pivot shaft to turn the first and second rollers at the same rate.

3. A pivoting feed roller as in claim 1 wherein, the pivoting feed roller is attached to a sewing machine.

4. A pivoting feed roller as in claim 1 wherein, the sewing machine has wheels to propel the sewing machine along a workpiece it is sewing.

5. A pivoting feed roller as in claim 1 wherein, the rollers are serrated to grip a workpiece.

6. A pivoting feed roller as in claim 1 wherein, the rollers are ribbed to grip a workpiece.

7. A pivoting feed roller as in claim 1 wherein, the rollers have rubber to grip a workpiece.

8. A pivoting feed roller as in claim 1 wherein, the rollers are plastic.

9. A pivoting feed roller as in claim 1 having, an adjustable compression on the spring loaded rod.

* * * * *